US010069211B2

(12) United States Patent
Tonn

(10) Patent No.: US 10,069,211 B2
(45) Date of Patent: Sep. 4, 2018

(54) BROADBAND CIRCULARLY POLARIZED PATCH ANTENNA AND METHOD

(71) Applicant: David A Tonn, Charlestown, RI (US)

(72) Inventor: David A Tonn, Charlestown, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 250 days.

(21) Appl. No.: 15/267,219

(22) Filed: Sep. 16, 2016

(65) Prior Publication Data

US 2018/0083360 A1 Mar. 22, 2018

(51) Int. Cl.

| | |
|---|---|
| ***H01Q 15/00*** | (2006.01) |
| ***H01Q 15/24*** | (2006.01) |
| ***H01Q 13/28*** | (2006.01) |
| ***H01Q 9/04*** | (2006.01) |
| ***H01Q 15/12*** | (2006.01) |
| ***H01Q 19/06*** | (2006.01) |

(52) U.S. Cl.

CPC ..... *H01Q 15/24* (2013.01); *H01Q 9/0407* (2013.01); *H01Q 9/0428* (2013.01); *H01Q 13/28* (2013.01); *H01Q 15/0026* (2013.01); *H01Q 15/0073* (2013.01); *H01Q 15/12* (2013.01); *H01Q 19/06* (2013.01)

(58) Field of Classification Search

CPC ..... H01Q 9/0428; H01Q 9/0407; H01Q 1/38; H01Q 1/40; H01Q 1/405; H01Q 15/04; H01Q 15/06; H01Q 15/08; H01Q 15/10; H01Q 15/12; H01Q 15/02; H01Q 15/242; H01Q 15/0026; H01Q 15/006; H01Q 15/0073; H01Q 15/246; H01Q 19/06; H01Q 19/09; G02B 5/3041; G02B 5/305; G02B 5/3083; G02B 27/286

See application file for complete search history.

(56) References Cited

U.S. PATENT DOCUMENTS

| | | | | |
|---|---|---|---|---|
| 2,554,936 A * | 5/1951 | Burtner | H01Q 3/14 | 333/21 A |
| 6,667,720 B1 * | 12/2003 | Anderton | H01Q 3/20 | 343/757 |
| 6,788,461 B2 * | 9/2004 | Kurtz | G02B 5/3058 | 359/485.03 |
| 7,561,332 B2 * | 7/2009 | Little | B82Y 30/00 | 349/1 |
| 9,281,568 B1 * | 3/2016 | Tonn | H01Q 9/0414 | |
| 9,819,094 B2 * | 11/2017 | Matitsine | H01Q 19/06 | |

(Continued)

*Primary Examiner* — Dameon E Levi
*Assistant Examiner* — Ab Salam Alkassim, Jr.
(74) *Attorney, Agent, or Firm* — James M. Kasischke; Michael P. Stanley

(57) ABSTRACT

An antenna for connection to a feed includes a substrate with a conductive ground plane. An emitter is positioned on the top face of the substrate, and the feed is connected to the emitter and ground plane. A spacer is positioned on the substrate above the emitter and one layer of high dielectric constant rods is positioned above the spacer. The rods are positioned in a single plane, coplanar with the emitter, and parallel to the dominant current distribution when the emitter is active. Further layers of spacers and rods can be positioned at a predetermined angle to the rods beneath. A kit is further provided for application of spacers and rods to preexisting antennas.

20 Claims, 5 Drawing Sheets

(56) References Cited

U.S. PATENT DOCUMENTS

| | | | | |
|---|---|---|---|---|
| 2003/0214439 | A1* | 11/2003 | Huebner | H01Q 15/242 343/700 MS |
| 2006/0119937 | A1* | 6/2006 | Perkins | G02B 5/3058 359/485.03 |
| 2006/0262397 | A1* | 11/2006 | Lee | G02B 5/3025 359/485.05 |
| 2007/0139772 | A1* | 6/2007 | Wang | G02B 5/3083 359/487.03 |
| 2011/0175779 | A1* | 7/2011 | Ju | H01Q 1/38 343/755 |
| 2012/0257168 | A1* | 10/2012 | Ishimatsu | G02B 5/3058 353/20 |
| 2014/0254976 | A1* | 9/2014 | Thomson | H01P 1/173 385/11 |
| 2015/0349431 | A1* | 12/2015 | Odes | G06F 17/10 343/756 |
| 2016/0341858 | A1* | 11/2016 | Magnusson | G02B 5/3008 |
| 2017/0271776 | A1* | 9/2017 | Biancotto | H01Q 13/02 |

* cited by examiner

BROADBAND CIRCULARLY POLARIZED PATCH ANTENNA AND METHOD

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

None.

BACKGROUND OF THE INVENTION

(1) Field of the Invention

The present invention provides a method and apparatus for a broadband circularly polarized patch antenna.

(2) Description of the Prior Art

A patch antenna, also referred to as a microstrip antenna, is a type of radio antenna with a low profile that can be mounted on a flat surface. The patch antenna includes a flat conductor mounted on a dielectric substrate over a larger conductor, typically referred to as a ground plane. The two metal surfaces form a resonant piece of microstrip transmission line. The patch is designed to have a length of approximately one-half wavelength of the radio waves being transmitted or received. A patch antenna can be constructed using the same technology as that used to make a printed circuit board.

A common means of obtaining a circularly polarized signal from a rectangular patch antenna of this type is to locate the feed point along a major diagonal of the patch. Other methods such as trimming the corners of the patch are often employed in conjunction with this diagonal feed arrangement. This approach stimulates two orthogonal modes of current flow on the patch, but these two modes are in quadrature. The combination of the modes yields circular polarization, but only over a narrow range of frequencies. Broader band performance is desirable while also maintaining circular polarization. This broadband performance should be achieved without negatively affecting the axial ratio of the antenna.

Thus, there is a need for circularly polarized antennas having broader bandwidth. There is a further need for adapting existing patch antennas to improve the bandwidth and axial ratio.

SUMMARY OF THE INVENTION

Accordingly, it is an object of the present invention to provide a patch antenna having improved impedance bandwidth and optimized axial ratio over a wide range of frequencies.

Another object is to provide method for retrofitting an existing patch antenna to make an improved circularly polarized antenna.

Yet another object is to provide a kit that can be used to retrofit an existing patch antenna.

In view of these objects, there is provided an antenna for connection to a feed that includes a substrate with a conductive ground plane. An emitter is positioned on the top face of the substrate, and the feed is connected to the emitter and ground plane. At least one coupling layer is positioned on the substrate above the emitter. The coupling layer includes a low dielectric constant spacer and one layer of high dielectric constant rods. The rods are positioned in a single plane, coplanar with the emitter, and parallel to the dominant current distribution when the emitter is active. Further coupling layers can be positioned at a predetermined angle relative to the rods beneath. The predetermined angle is calculated according to the antenna parameters to give circular polarization at a design frequency or range of frequencies. A kit and method are further provided for enhancement of preexisting antennas.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
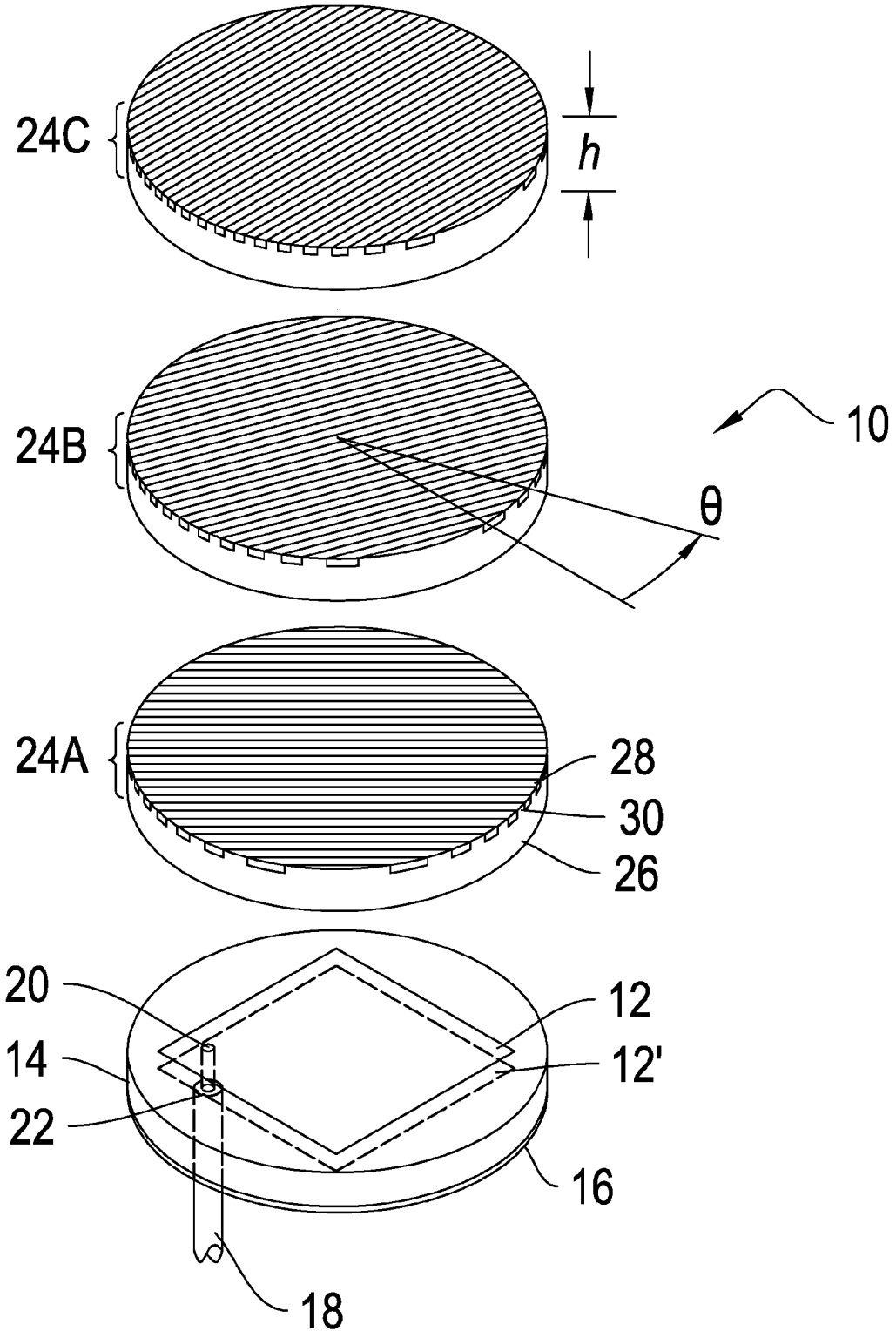
FIG. 1 is an exploded isometric view of an embodiment of the antenna.

FIG. 1 provides an exploded view of a first embodiment 10. The emitter 12 includes a narrowband resonant, circularly polarized patch positioned on a substrate 14 above a ground plane 16. The emitter 12 is a conductive patch that can be printed on either a square, rectangular, or circular substrate 14. Emitter 12 can also have a conductive patch that acts as a parasitic emitter 12' for operation at two frequencies simultaneously. Ground plane 16 is a conductive layer that is printed or deposited on a bottom surface of substrate 14. Emitter 12 is fed by means of a coaxial probe 18 whose center conductor 20 penetrates the substrate 14 without contacting it and connects to the emitter 12 above. An outer conductor 22 of the coaxial probe 18 is connected to the ground plane 16 of the grounded substrate 14. (Parasitic emitter 12' is not joined to ground plane 16 or either conductor of coaxial probe 18. The emitter 12 is of resonant size and the dielectric substrate 14 is electrically very thin. (i.e., much smaller than a wavelength. This relates to the bandwidth of the antenna, but a thicker substrate 14 has undesirable trade offs.) Emitter 12 can also be a single patch.

This embodiment further includes a series of coupling layers 24A, 24B and 24C of low dielectric constant spacers 26 and parallel high dielectric constant rods 28 in layers above emitter 12. Spacers 26 can be made from syntactic foam, polystyrene foam, polyethylene foam or any number of other polymer foams. The relative permittivity $\varepsilon_r$ of this low dielectric constant material should be between about 1.2 and 1.8. In the tested embodiment, the relative permittivity was 1.6. Rods 28 are preferably square in cross section and uniformly spaced. Rods 28 are arranged so that they are co-planar and parallel to the plane of the emitter 12 below. In the tested embodiment, the high dielectric constant rods 28 were made from zirconium oxide ($ZrO_2$) ceramic having a permittivity $\varepsilon_r$~30. Other high dielectric material can be used for rods 28 if it has a permittivity $\varepsilon_r$ between about 25 to 35. Low dielectric constant material 30 can be between high dielectric constant rods 28. Material 30 is not required to be the same material as used for spacers 26. The ends of the rods 28 and spacers 26 can be truncated to conform to a circular disk arrangement, as shown in FIG. 1; however, this is not critical, and other form factors can be used.

On first layer 24A, rods 28 are arranged so that their long dimension is parallel to the dominant current distribution on the patch, which for a rectangular patch is the long dimension of emitter 12 or patch. This arrangement by itself allows for some improvement in bandwidth, but not axial ratio. To obtain improvements in both performance metrics, successive layers are added.

Rods 28 on each successive layer 24B and 24C are rotated by a fixed angle θ. In this way the rods form a lattice arrangement that makes a clear path for the rotating, circularly polarized signal. In FIG. 1, three layers 24A, 24B, and 24C of rods 28 are shown, with each layer rotated a fixed angle θ=15° counterclockwise relative to the layer beneath it when viewed from above. This arrangement yields a right-hand circularly polarized (RHCP) signal. (For a left-hand circularly polarized (LHCP) signal, successive layers would be rotated 15 degrees in a clockwise direction when viewed from above, with a corresponding change in the emitter to stimulate an LHCP mode.) There is a relationship between the fixed angle θ and the thickness, h, of the spacer layers and the rods in order to accommodate circular polarization of the signal. At a design wavelength λ the circularly polarized signal turns 360° every wavelength λ, so 15° represents λ/24 which is the optimal thickness h of the spacer and rod combination for 15°. The relationship between the thickness h and fixed angle θ can be optimized for a given wavelength λ and the available components. A thicker antenna can be made with a fixed angle θ greater than 15° and a thinner antenna can be made with a fixed angle less than 15°. The thickness of components can be optimized to the particular center frequency or wavelength of the antenna.

Each of the layers 24A, 24B and 24C should be electrically thin, in other words, thickness h should be smaller than one tenth of a free space wavelength. The total structure 10 does not need to be electrically thin due to the several layers present. Embodiment 10 can be between one fourth and one half of a free space wavelength λ.

While the exact mechanism by which this works is still under investigation, it appears that rods 28 are aligned so that they couple capacitively with the current on the emitter 12 below in such a manner as to increase radiated power from the antenna 10 without increasing stored energy (e.g., reactive power). This yields an improvement in bandwidth. The alignment of rods 28 relative to the axis of the emitter 12 is a key requirement. If rods 28 are misaligned, the coupling is minimized and the effect falls apart. The rotation of the successive layers of rods, along with the capacitance between those layers, imparts a degree of chirality to the structure and prevents the rod array from becoming a polarization filter and giving a linearly polarized signal.

In a tested model of the embodiment, emitter 12, parasitic emitter 12' and ground plane 14 are from a preexisting GPS dual band stacked patch resonant antenna. Design parameters for layers 24A, 24B, and 24C were chosen based on parametric analysis of the basic geometry shown in FIG. 1. Spacer 26 base thickness: 8 mm; spacer diameter, 152.4 mm (6 in.); spacer material, syntactic foam ($\varepsilon_r$~1.6); rod dimensions, square cross section, 6 mm on a side; rod material, zirconium oxide ($ZrO_2$) ceramic ($\varepsilon_r$~30); rotation angle θ between layers, 15°. Spacer material 30 was positioned between rods 28. Three layers appear to work best for this antenna; one and two layer approaches did not preserve the axial ratio of the antenna, while four layers adversely affected bandwidth performance.

Figure 2:
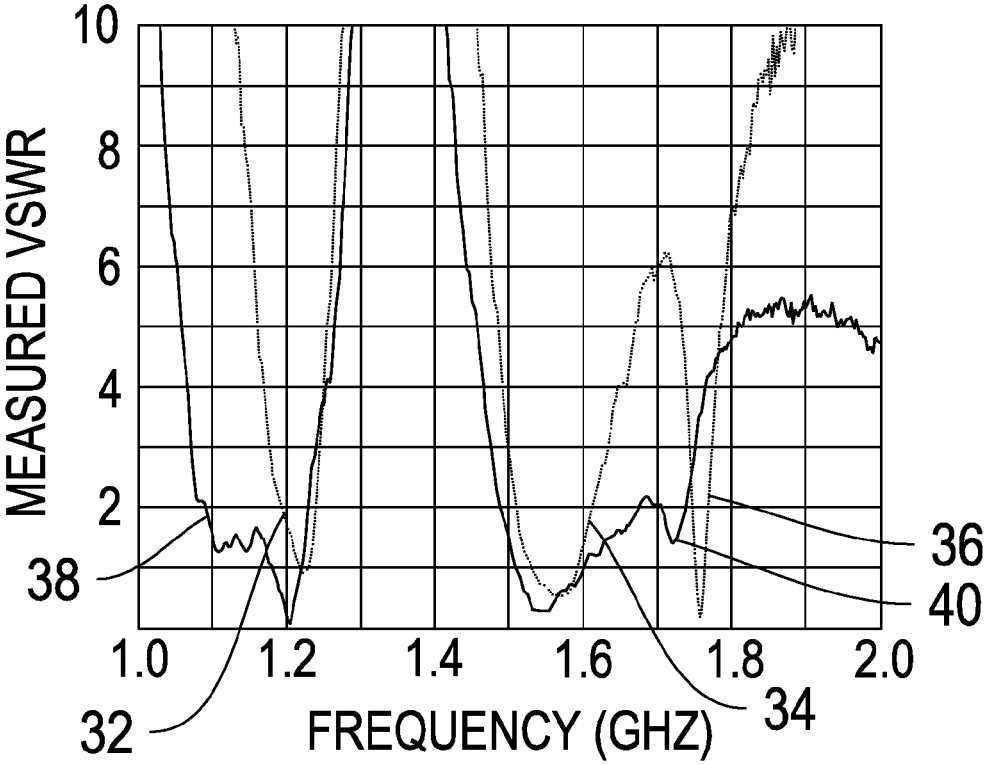
FIG. 2 is measured graph of voltage standing wave ratio (VSWR) for a prior art patch antenna and an antenna constructed in accordance with this disclosure.
Figure 3A:
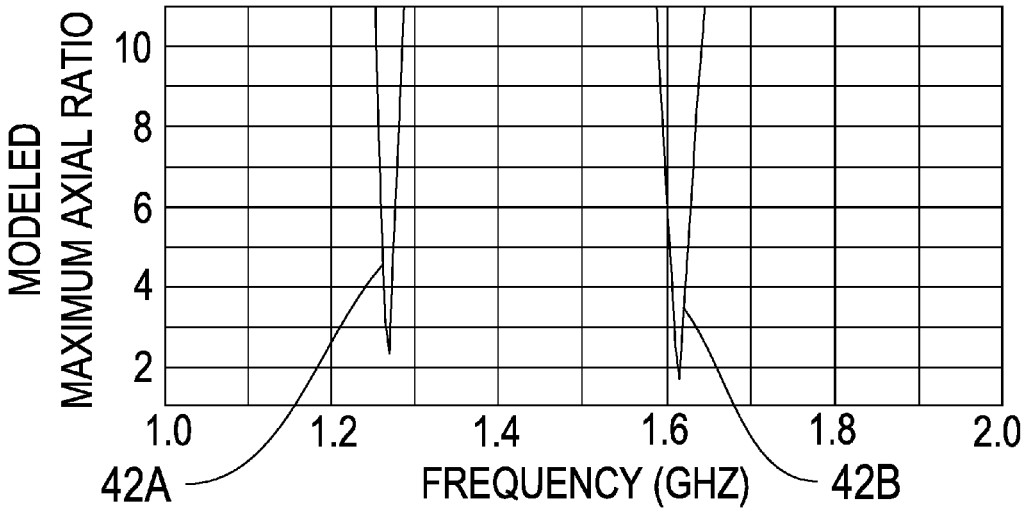
FIG. 3A is a modeled graph of maximum axial ratio for a prior art patch antenna.
Figure 3B:
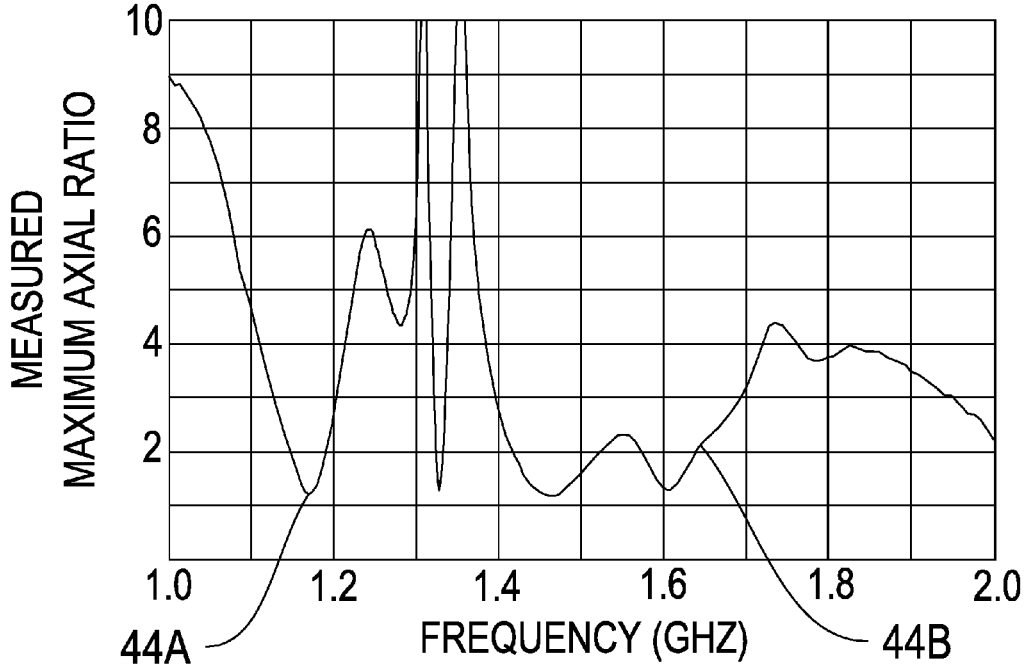
FIG. 3B is a measured graph of maximum axial ratio for an antenna constructed in accordance with this disclosure.

In FIG. 2, a dotted line, identified at 32, 34, and 36, shows a measured VSWR of an antenna made from the emitter, substrate and ground plane alone. The solid line in FIG. 2, identified at 38 and 40, shows a measured VSWR of the embodiment shown in FIG. 1 having spacers and rods as described above. FIG. 3A is a modeled graph of the maximum axial ratio of an antenna made from the emitter, substrate and ground plane alone. FIG. 3B is a measured graph of the embodiment shown in FIG. 1 having spacers and rods described above.

In the VSWR graph shown in FIG. 2, the passband is the portion of the spectrum where the VSWR is less than 3:1. FIG. 2 shows a first passband 32 between about 1.175 and 1.242 GHz. A second passband 34 is between about 1.5 GHz and 1.625 GHz. There is a third, very narrow passband 36 between about 1.737 and 1.75 GHz. Increased passband widths are indicated at 38 and 40. These are obtained by utilizing layers 24A, 24B, and 24C as shown in FIG. 1. Passband 38 is broadened to extend between about 1.075 and 1.237 GHz. Second passband 40 is broadened to extend between about 1.475 and 1.76 GHz. FIG. 3A at 42A shows the maximum axial ratio versus frequency for the prior art antenna at the peak of the beam (i.e., at zenith along the z axis) and at 42B in a 15 degree cone about the z axis. A general rule of thumb for measuring the quality of a circularly polarized signal is that the axial ratio should be no more than 3 dB. In FIG. 3B, curves 44A and 44B show the maximum axial ratio versus frequency for the antenna according to the embodiment in FIG. 1. In FIG. 3B, curve 44A is the maximum axial ratio at the peak of the beam, and curve 44B is the maximum axial ratio in a 15 degree cone about the z axis. These plots show that not only is the axial ratio preserved at the zenith but also away from the peak of the beam, making the antenna useful for illuminating a large target with a circularly polarized beam.

These figures indicate that not only has the bandwidth of the antenna been increased, but the axial ratio has been preserved as well. This is significant, since other methods for producing broadband circularly polarized patch antennas start with a broadband radiator such as a spiral, not a narrowband resonant patch. This result shows the utility in retrofitting existing antenna installations to increase bandwidth and with it, overall capability.

Additionally, further testing has shown that the radiation pattern of the antenna remains stable with a single well defined main beam across the two passbands. The beamwidth does change in some cases, but no nulls appear in the main beam. In portions of the spectrum outside of the passbands, the pattern was observed to break up, in some cases into several lobes in different directions as one might expect.

Figure 4A:
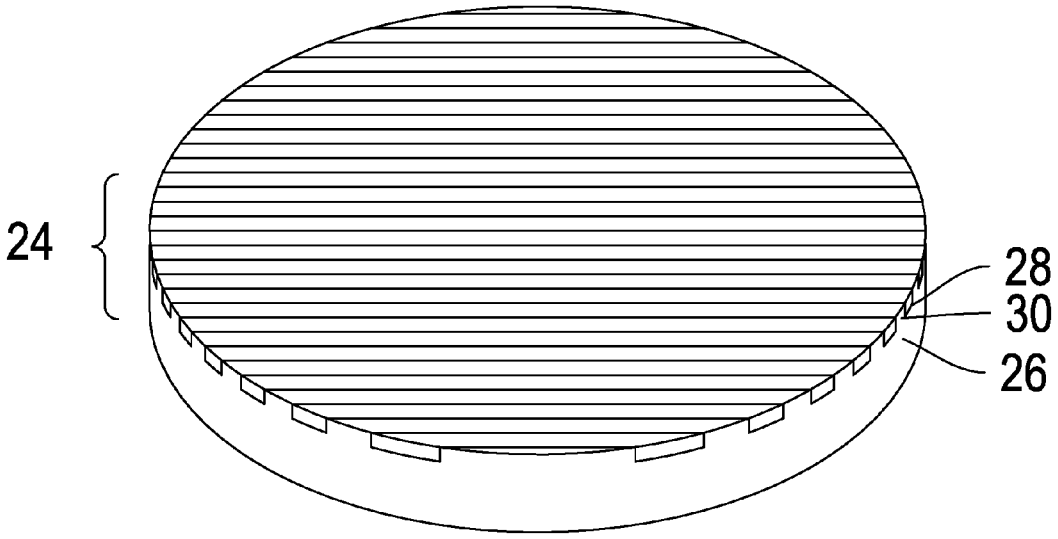
FIG. 4A is an isometric view of an embodiment of the coupling layer.

FIGS. 4A, 4B, 4C, and 4D depict alternate embodiments for the coupling layers 24, 24', 24", and 24''' respectively. In FIG. 4A, coupling layer 24 has spacer 26 made from low dielectric constant material. High dielectric constant rods 28 are positioned above spacer 26. Low dielectric material 30 is positioned between rods 28. Coupling layer 24 can be constructed many different ways. A first method of construction is by providing grooves on top of spacer 26 and providing rods 28 in grooves. Remaining spacer material 30 is then between rods 28. A second method is to position rods 28 on the top of spacer 26. Low dielectric material portions 30 can then be placed between rods 28. This construction can be adhered to form a layer by means known in the art. The coupling layer can also be made by molding the spacer material around the rods.

Figure 4B:
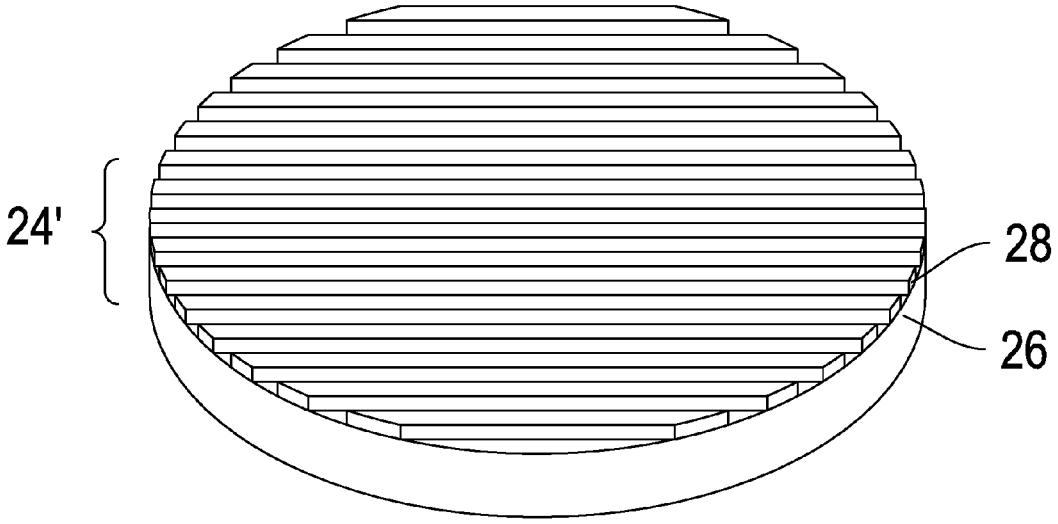
FIG. 4B is an isometric view of a second embodiment of the coupling layer.

FIG. 4B shows an alternate coupling layer 24'. Rods 28 are positioned directly on top of spacer 26. As before, an adhesive can be used to retain rods 28 on spacer 26. Gaps between rods 28 can be filled by air, sealed with a vacuum or provided with some other low permittivity fluid.

Figure 4C:
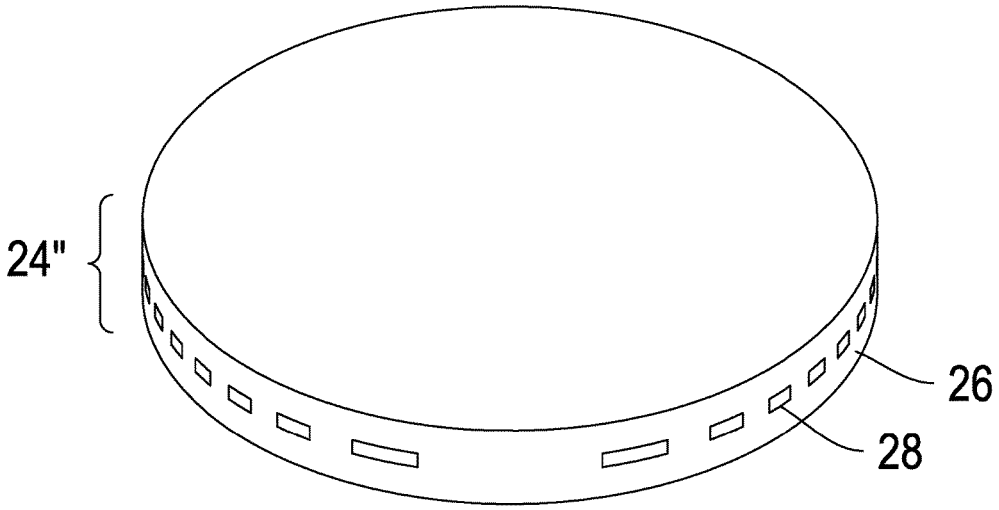
FIG. 4C is an isometric view of a third embodiment of the coupling layer.

FIG. 4C shows another alternate coupling layer 24". In this embodiment, rods 28 are embedded in low dielectric spacer 26. In order to preserve the proper rotation, care should be taken to insure that layers 24" are properly spaced vertically. A first low dielectric material spacer can be used for this purpose.

Figure 4D:
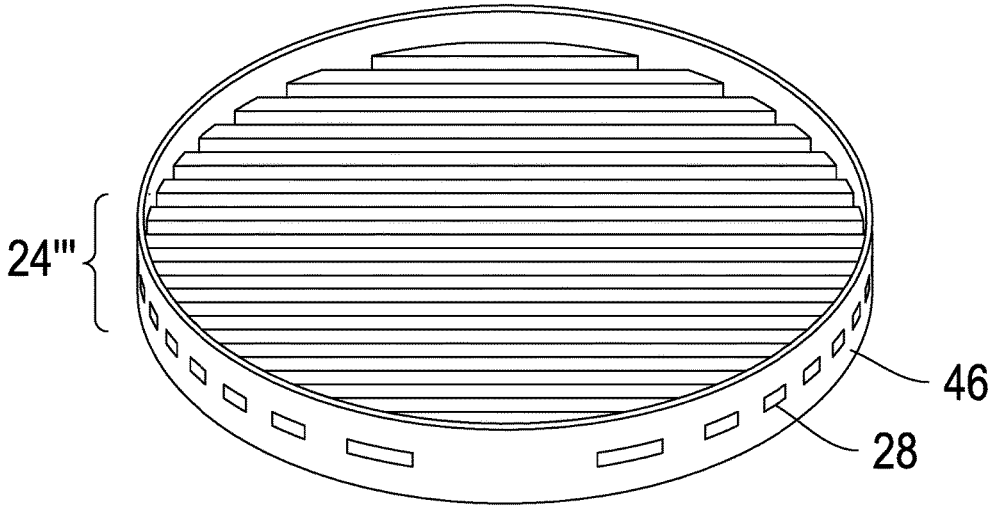
FIG. 4D is an isometric view of a fourth embodiment of the coupling layer.

FIG. 4D shows an alternate embodiment having a coupling layer 24''' utilizing a frame 46 for retaining rods 28 with the proper spacing. Frame 46 replaces spacer 26 and serves to retain rods 28 at the desired position from each other and from other coupling layers 24'''. Air, vacuum or other low permittivity fluid can be in the volume defined by frame 46 between rods 28. Frame 46 should be made from a structurally rigid, low permittivity material. There are many possible embodiments envisioned within the scope of these claims.

The apparatus described herein improves the bandwidth and axial ratio performance of an existing conventional patch antenna. Previously this required changing the geometry of the original antenna. Utilizing the techniques herein a broadband antenna can be provided in a compact configuration, but also these techniques provide for retrofit of an existing antenna to yield increased bandwidth to support new and emerging requirements.

Although the preferred embodiment of this invention uses square rods of zirconium oxide, it also works for rods that are circular in cross section, provided that their center to center spacing and other parameters remain essentially the same as their square cross section counterparts. Also, though zirconium oxide rods are preferred, any dielectric material which has a dielectric constant in the range of 25-35 appears to work.

It will be understood that many additional changes in the details, materials, steps and arrangement of parts, which have been herein described and illustrated in order to explain the nature of the invention, may be made by those skilled in the art within the principle and scope of the invention as expressed in the appended claims.

The foregoing description of the preferred embodiments of the invention has been presented for purposes of illustration and description only. It is not intended to be exhaustive nor to limit the invention to the precise form disclosed; and obviously many modifications and variations are possible in light of the above teaching. Such modifications and variations that may be apparent to a person skilled in the art are intended to be included within the scope of this invention as defined by the accompanying claims.

What is claimed is:

1. An antenna for connection to a feed comprising:

a substrate having a bottom face and a top face;

a ground plane positioned on the bottom face of said substrate and connected to a first element of the feed;

an emitter positioned on the top face of said substrate and connected to a second element of the feed for producing a circularly polarized electromagnetic signal having a dominant current distribution in said emitter;

at least one spacer positioned on the top face of said substrate above said emitter; and at least one layer of high dielectric constant rods positioned on a top surface of said at least one spacer, said plurality of high dielectric constant rods being positioned in a single plane, parallel with each other, parallel with said emitter and oriented parallel to the dominant current distribution when the emitter is active.

2. The antenna of claim 1 further comprising:

an additional spacer positioned on top of said layer of high dielectric constant rods; and an additional layer of high dielectric constant rods positioned on a top of said additional spacer, said high dielectric constant rods being positioned in a single plane, parallel with each other, parallel with said emitter and oriented at a predetermined non-zero angle with respect to said high dielectric constant rods on said layer beneath.

3. The antenna of claim 2 wherein the predetermined non-zero angle is calculated based on a design frequency and polarization for the antenna, a thickness of said spacers and a thickness of said layer of high dielectric constant rods.

4. The antenna of claim 1 wherein said high dielectric constant rods are rectangular in cross-section.

5. The antenna of claim 1 wherein said high dielectric constant rods have a relative permittivity, $\varepsilon_r$, of about 25 to 35.

6. The antenna of claim 5 wherein said high dielectric constant rods are made from zirconium oxide ceramic.

7. The antenna of claim 1 wherein said spacer has a relative permittivity, $\varepsilon_r$, of about 1.2 to 1.8.

8. The antenna of claim 7 wherein said spacer is made from syntactic foam.

9. The antenna of claim 1 wherein said emitter is a stacked emitter having at least two design frequencies.

10. A kit for application to a patch antenna comprising:

at least one spacer positioned on the top face of said patch antenna; and at least one layer of high dielectric constant rods positioned on a top surface of said at least one spacer, said plurality of high dielectric constant rods being positioned in a single plane, parallel with each other, parallel with the patch antenna and oriented parallel to the dominant current distribution in the patch antenna when the patch antenna is active.

11. The kit of claim 10 further comprising:

an additional spacer positioned on top of said layer of high dielectric constant rods; and an additional layer of high dielectric constant rods positioned on a top of said additional spacer, said high dielectric constant rods being positioned in a single plane, parallel with each other, parallel with the patch antenna and oriented at a predetermined non-zero angle with respect to said high dielectric constant rods on said layer beneath.

12. The kit of claim 11 wherein the predetermined angle is calculated based on a design frequency for the patch antenna, a thickness of said spacers and a thickness of said layer of high dielectric constant rods.

13. The kit of claim 10 wherein said high dielectric constant rods are rectangular in cross-section.

14. The kit of claim 10 wherein said high dielectric constant rods have a relative permittivity, $\varepsilon_r$, of about 25 to 35.

15. The kit of claim 14 wherein said high dielectric constant rods are made from zirconium oxide ceramic.

16. The kit of claim 10 wherein said spacer has relative permittivity, $\varepsilon_r$, of about 1.2 to 1.8.

17. The kit of claim 16 wherein said spacer is made from syntactic foam.

18. A method for improving a circularly polarized patch antenna comprising the steps of:

providing a plurality of high dielectric constant rods;

arranging said rods in a first plane parallel with the patch antenna at a predetermined distance above the patch antenna; and orienting said rods parallel to the dominant current distribution in the patch antenna when the patch antenna is active.

19. The method of claim 18 further comprising the step of arranging said rods in at least one additional plane parallel with the first plane and at a predetermined distance thereabove, said rods in each said additional plane being oriented at a predetermined non-zero angle to said rods in the plane below.

20. The method of claim 19 further comprising the steps of:

providing a retaining structure between said rods in said first plane and the patch antenna for maintaining the predetermined distance; and providing an intermediate retaining structure between said rods in said additional plane and the plane below for maintaining the predetermined distance and predetermined non-zero angle.

* * * * *